United States Patent [19]

Evans

[11] Patent Number: 4,666,000

[45] Date of Patent: May 19, 1987

[54] ROCK BIT CUTTER RETAINER

[75] Inventor: Robert F. Evans, Dallas, Tex.

[73] Assignee: Varel Manufacturing Co., Dallas, Tex.

[21] Appl. No.: 819,030

[22] Filed: Jan. 15, 1986

[51] Int. Cl.[4] ..... E21B 10/22

[52] U.S. Cl. ..... 175/369; 175/371; 384/96

[58] Field of Search ..... 175/358, 359, 367, 369, 175/370, 371, 328; 299/91; 384/95, 96

[56] References Cited

U.S. PATENT DOCUMENTS

| | | | |
|---|---|---|---|
| 1,835,523 | 12/1931 | Reed . | |
| 1,839,589 | 1/1932 | Reed . | |
| 1,865,706 | 7/1932 | Reed . | |
| 1,921,702 | 8/1933 | Reed | 255/71 |
| 2,004,012 | 6/1935 | Reed | 384/96 |
| 2,004,013 | 6/1935 | Reed | 384/96 |
| 2,065,740 | 12/1936 | Reed | 384/96 |
| 2,075,997 | 4/1937 | Reed | 384/96 |
| 2,076,001 | 4/1937 | Reed | 384/96 |
| 2,351,357 | 6/1944 | Miller et al. | 384/96 |
| 2,664,321 | 12/1953 | Noble | 175/369 |
| 4,067,406 | 1/1978 | Garner et al. | 175/341 |
| 4,108,260 | 8/1978 | Bozarth | 175/374 |
| 4,157,122 | 6/1979 | Morris | 175/369 |
| 4,161,343 | 7/1979 | Brashear | 308/8.2 |
| 4,236,764 | 12/1980 | Galle | 175/369 |
| 4,266,622 | 5/1981 | Vezirian | 175/366 |
| 4,344,658 | 8/1982 | Ledgerwood | 175/369 |
| 4,444,518 | 4/1984 | Schramm et al. | 175/369 |
| 4,491,428 | 1/1985 | Burr et al. | 384/93 |

OTHER PUBLICATIONS

"Varel Drilling Bits," Varel Manufacturing Company, p. 6783 (undated).

*Primary Examiner*—James A. Leppink
*Assistant Examiner*—Terry Lee Melius
*Attorney, Agent, or Firm*—Harold E. Meier

[57] ABSTRACT

An improved retainer for a rotary cone rock bit and a method for inserting the same is disclosed. A cone cutter is mounted on a bearing pin of an arm of the rotary cone drill bit. Formed in the bearing pin and the inner wall of the cone cutter is an annular channel that is filled with discs through an insertion cavity and the insertion cavity is subsequently sealed. This enables the bearing surface and the bushing engaging the bearing pin to be substantially longer than heretofore possible and the wobble of the cone cutter about the bearing pin is reduced.

9 Claims, 5 Drawing Figures

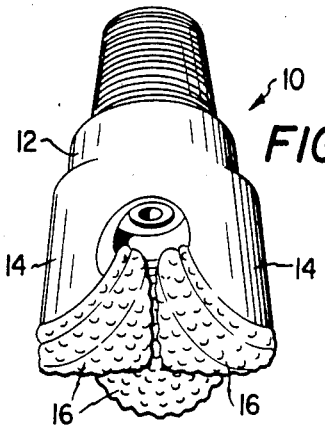
FIG. 1
FIG. 2
(PRIOR ART)
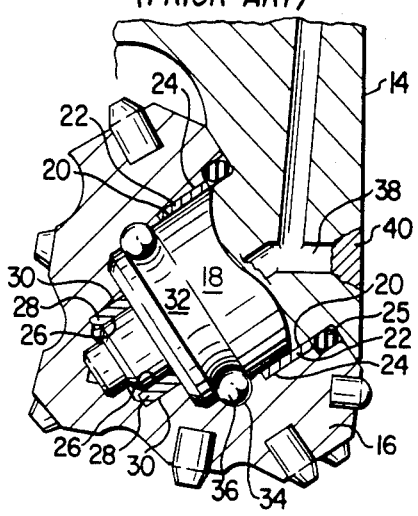
FIG. 5
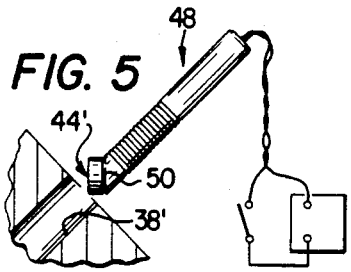
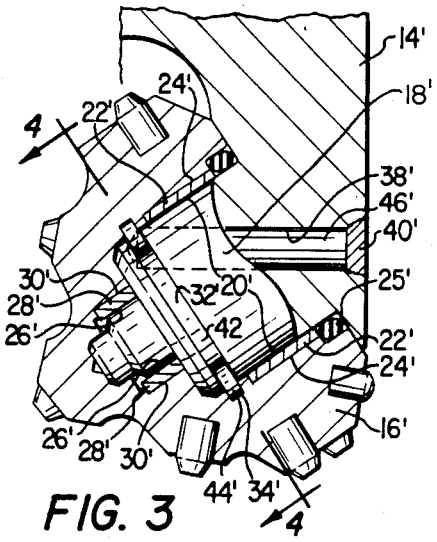
FIG. 3
FIG. 4
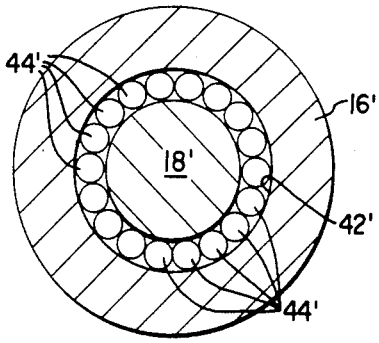

ROCK BIT CUTTER RETAINER

TECHNICAL FIELD

This invention relates to an earth-boring rotary cone drill bit and more particularly to an improved means for retaining a rotatable cone cutter on a supporting pin of such a drill bit.

BACKGROUND OF THE INVENTION

A rotary cone rock bit is that part of a rotary drill string that performs the actual drilling operations. As a drill string rotates, the bit disintegrates the earth formation and forms a bore hole. The bit comprises a body attached to the drill string and journal legs extending downward from the body. The lower end of each journal leg forms a cantilever supporting shaft or bearing pin and rotatably mounted to each bearing pin is a cone cutter specifically designed for the formation to be cut.

Previously, the cone cutter was retained on the bearing pin by cutting semicircular grooves in the inner wall of the cone cutter and the outer wall of the bearing pin. These grooves are assembled to form a toroidal channel, which channel was filled with ball bearings for retention as well as rotational purposes. Though this method is sound for retention purposes, the grooves and ball bearings occupy a large longitudinal space and consequently the bushing area of the bearing pin must be shortened. Such a short bushing destabilizes the cone cutter and increases bushing wear and the tendency of the cone to wobble. Increased wobbling puts strain on the cone seal, which then wears rapidly thereby allowing lubricant to escape and abrasive and destructive material to enter the bearing area. This decreases the durability and longevity of the bit as a whole.

Other retention methods include snap rings, see U.S. Pat. No. 4,491,428 and segmented rings, see U.S. Pat. No. 4,444,518. These retention methods require close tolerances, are difficult to manufacture, and have significant slippage problems.

SUMMARY OF THE INVENTION

The present invention provides an improved means for rotatably retaining the cone cutter on the cantilever bearing pin that is easily manufactured, functional and durable. Narrow annular grooves are cut into the inside wall of the cone cutter and on the outside wall of the bearing pin so that when the cone cutter is assembled on the bearing pin the grooves form a narrow annular channel. Circular discs are assembled into the annular channel and sealed in place. The discs allow free rotation of the cutter cone and also retain the cone on the bearing pin. The narrow thickness of the discs and the annular channel permits use of a longer bushing and gives the cone cutter improved stable support at the base of the bearing pin. This reduces the tendency of the cone cutter to wobble, thereby increasing the durability and enhancing the life of the rock bit.

BRIEF DESCRIPTION OF THE DRAWINGS

A more complete understanding of the invention may be had by reference to the following detailed description when taken in conjunction with the accompanying drawings wherein:

FIG. 1 is a perspective view of a rotary cone rock bit;

FIG. 2 is a cross-sectional view of a prior cone cutter attached to a bearing pin;

FIG. 3 is a cross-sectional view of a cone cutter on a bearing pin held in place according to the present invention by a plurality of discs;

FIG. 4 is a cross-sectional view taken along the line 4—4 of FIG. 3; and

FIG. 5 is a cross-sectional view showing one method of loading the discs in an assembled drill bit.

DETAILED DESCRIPTION OF THE INVENTION

FIG. 1 depicts a rotary cone rock bit 10 including a body 12 having a threaded end for attachment to the drill string. Journal legs 14, three for the rock bit illustrated, extend down from the body 12. The lower end of each journal leg 14 supports a cone cutter 16.

As shown in FIG. 2, the end of each journal leg 14 forms a cantilever bearing pin 18. An upper bearing surface 20 formed on the bearing pin 18 engages a bushing 22 extending around the bearing pin 18. The bushing 22 is press fit into a bearing surface 24 formed in the inside wall of the cone cutter 16. A seal 25 is mounted around the journal leg 14 to prevent the entrance of contaminants into the bearing areas. Similarly, a lower bearing surface 26 is formed on the lower end of the bearing pin 18 and engages a bushing 28. The bushing 28 is press fit into a bearing surface 30 cut in the inside wall of the cone cutter 16. Roller bearings may be used in place of the bushings 22 and 28.

In the drill bit shown in FIG. 2, a semi-circular groove 32 is formed around the bearing pin 18 and a corresponding semi-circular groove 34 is formed around the inside wall of the cone cutter 16. When the cone cutter 16 is in place on the bearing pin 18 the two semi-circular grooves 32 and 34 form a toroidal channel around the bearing pin 18 and the cone cutter 16. Ball bearings 36 are inserted into the toroidal channel through a loading hole 38 and the loading hole 38 is sealed by a weld 40. The ball bearings 36 thus act to retain the cone cutter 16 on the bearing pin 18. However, because of the relatively large diameter of the ball bearings 36, the bearing surfaces 20 and 24 and the bushing 22 must be shortened to provide the space required for the ball bearings 36.

FIG. 3 shows a cross-sectional view of the rotary cone rock bit according to the present invention. Parts corresponding to those shown in FIG. 2 are numbered using the same numbers as in FIG. 2 with a prime (') designation. Thus, a cantilever bearing pin 18 formed on the end of a journal leg 14'holds a cone cutter 16 . A seal 25' prevents contamination of the interface between the journal leg 14' and the inside wall of the cone cutter 16 . An upper bearing surface 20' engages a bushing 22' in the upper section of the bearing pin 18' and a lower bearing surface 26' engages a bushing 28' in the lower section of the bearing pin 18 . However, semi-circular grooves 32' and 34' are not present in FIG. 3. Rather than the toroidal channel of the prior art, annular grooves 32' and 34' are cut into the bearing pin 18' and the inside wall of the cone cutter 16' so that when those grooves 32' and 34' line up a narrow annular channel 42' is formed.

As shown in FIG. 4, a cross-sectional view taken along the line 4—4 of FIG. 3, the annular channel 42' is filled with discs 44'. These discs 44' are inserted into the annular channel through a loading hole 38'. The loading hole 38' is then filled with a rod 46' and welded shut as at 40'.

Because the annular channel 42' has a much smaller width than the toroidal channel shown in FIG. 2, the upper bearing surface 20' and the bushing 22' may be substantially longer than the corresponding parts shown in FIG. 2. Therefore, a more stable bearing is formed and the wobble of the cone cutter 16' about the bearing pin 18' is significantly reduced. This reduction in wobble stabilizes the cone cutter 16' and increases the life and durability of the rotary cone drill bit.

Referring to FIG. 5, there is shown apparatus including an electromagnet 48 for inserting the discs 44 through the insertion cavity 38' and into the annular channel 42'. The electromagnet 48 holds the disc 44' on its angular end 50 as it is inserted into and through the insertion cavity 38'. The disc 44' is held at an angle to coincide with the angle the insertion cavity 38' makes with the annular channel 42'. When the disc 44' is properly in place in the annular channel 42', the current to the electromagnet 48 is turned off and the disc is left in the annular channel.

Although a preferred embodiment of the invention has been illustrated in the drawings and described in the foregoing detailed description, it will be understood that the invention is not limited to the embodiment disclosed but is capable of numerous rearrangements, modifications and substitutions of parts, dimensions, and elements without departing from the spirit of the invention.

I claim:

1. In combination with a rotary cone rock bit having at least one cantilever one-piece bearing pin rotatably supporting a cone cutter, a cone cutter retainer comprising:

sleeve bearing means between surfaces of said bearing pin and said cone cutter, said bearing means assembled into the inside wall of said cone cutter;

a first annular channel formed around said bearing pin and a second annular channel formed around the inside wall of said cone cutter so that said annular channels are aligned to define an enclosure after said cone is assembled on said bearing pin, the base of each of said annular channels thereby forming opposing bearing surfaces;

a passage through said bearing pin for communicating with said enclosure;

a plurality of discs assembled through said passage into said enclosure formed by the annular channels, said discs being adjacent the bearing surfaces formed by said annular channels after the cone cutter has been positioned onto said bearing pin to retain said cutter on said pin; and a seal between said bearing pin and said cone cutter to establish a barrier between the internal space of said cone and the external space surrounding said cone.

2. The combination of claim 1 further comprising passage means extending between said annular channels and the exterior of said rotary cone rock bit for assembling said plurality of discs into said annular channels.

3. The combination of claim 1 wherein said discs have flat opposing surfaces substantially perpendicular to the rotational axis of the cone cutter when inserted into the annular channel.

4. In combination with a rotary cone rock bit having at least one cantilever one-piece bearing pin rotatably supporting a cone cutter, said cone cutter having an inside wall mounted to extend over said bearing pin, a bearing surface formed around the bearing pin and a bushing press fit into the inside wall of said cone cutter between said bearing surface and the inside wall of the cone cutter, a cone cutter retainer comprising:

corresponding annular channels cut around said bearing pin and around the inside wall of said cone cutter at said bearing surface, wherein said annular channels are aligned to define a narrow enclosure after the cone cutter is assembled on said bearing pin, the base of each of said annular channels thereby forming opposing bearing surfaces;

a passage through said bearing pin for communicating with said enclosure;

a plurality of discs assembled through said passage into said enclosure formed by the annular channels to retain said cone cutter on said bearing pin, each of said discs being adjacent both of the opposing bearing surfaces formed by the annular channels; and a seal between said bearing pin and said cone cutter to establish a barrier between the internal space of said cone and the external space surrounding said cone.

5. The combination of claim 4 further comprising passage means extending between said annular channel and the exterior of said rotary cone rock bit for assembling said plurality of discs into said annular channel.

6. The combination of claim 4 wherein said discs have flat opposing surfaces substantially perpendicular to the rotational axis of the cone cutter when assembled into the annular channel.

7. A rotary rock cone bit comprising:

a bit body with at least one journal leg extending downward therefrom;

a cantilever one-piece bearing pin on the lower end of said leg;

a cone cutter rotatably mounted on the end of the bearing pin;

sleeve bearing means between surfaces of said bearing pin and said cone cutter, said bearing means having been press fit into the inside wall of said cone cutter;

a first annular channel cut around said bearing pin and a second annular channel cut around the inside wall of said cone cutter so that said annular channels are aligned to define an enclosure between the bearing pin and the cone cutter after said cone is assembled on said bearing pin, the base of each of said annular channels threby forming opposing bearing surfaces;

a passage through said bearing pin for communicating with said annular channel;

a plurality of flat discs assembled in said enclosure for retaining the cone cutter on the bearing pin, said discs being assembled through said passage, said discs being adjacent the opposing bearing surfaces formed in the enclosure by the annular channels after the cone cutter is assembled on said bearing pin; and a seal between said bearing pin and said cone cutter to establish a barrier between the internal space of said cone and the external space surrounding said cone and thereby to prevent contaimination and leakage.

8. The rock bit of claim 7 wherein the flat faces of the discs are substantially perpendicular to the rotational axis of the cone cutter.

9. The rock bit of claim 7 further comprising an insertion cavity extending from an outer wall of the leg to the annular channel to provide a means for inserting said discs into the annular channel.

* * * * *